US010467960B2

(12) United States Patent
Do et al.

(10) Patent No.: US 10,467,960 B2
(45) Date of Patent: Nov. 5, 2019

(54) ELECTROLUMINESCENT DISPLAY DEVICE AND DRIVING METHOD OF THE SAME

(71) Applicant: LG Display Co., Ltd., Seoul (KR)

(72) Inventors: Osung Do, Paju-si (KR); Kyoungdon Woo, Paju-si (KR); Hyuckjun Kim, Goyang-si (KR); Jaeyoon Bae, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/858,917

(22) Filed: Dec. 29, 2017

(65) Prior Publication Data

US 2019/0035331 A1 Jan. 31, 2019

(30) Foreign Application Priority Data

Jul. 27, 2017 (KR) ..... 10-2017-0095415

(51) Int. Cl.
*G09G 3/34* (2006.01)
*G09G 3/3233* (2016.01)

(52) U.S. Cl.
CPC ..... *G09G 3/3233* (2013.01); *G09G 3/3413* (2013.01); *G09G 2300/0452* (2013.01); *G09G 2300/0842* (2013.01); *G09G 2320/0295* (2013.01); *G09G 2320/043* (2013.01); *G09G 2320/0693* (2013.01)

(58) Field of Classification Search
CPC ..... G09G 3/3233; G09G 3/3413
See application file for complete search history.

(56) References Cited

U.S. PATENT DOCUMENTS

2014/0198092 A1* 7/2014 Azizi ..... G09G 3/006 345/212
2017/0162113 A1* 6/2017 Lin ..... G09G 3/3233
2018/0137817 A1* 5/2018 Wu ..... G09G 3/3233

FOREIGN PATENT DOCUMENTS

| | | | |
|---|---|---|---|
| CN | 104750301 | A | 7/2015 |
| CN | 106328052 | A | 1/2017 |
| EP | 2 960 894 | A1 | 12/2015 |
| JP | 2011-523720 | A | 8/2011 |
| JP | 2016-009185 | A | 1/2016 |
| KR | 10-2017-0076952 | A | 7/2017 |

(Continued)

OTHER PUBLICATIONS

Taiwanese Office Action, dated May 8, 2018 for the Taiwanese patent application No. 106145392.

(Continued)

*Primary Examiner* — Charles V Hicks
(74) *Attorney, Agent, or Firm* — Polsinelli PC

(57) ABSTRACT

The present disclosure relates to an electroluminescent display device and a driving method of the same. The electroluminescent display device comprises a display panel, including a plurality of data lines, a plurality of sensing lines, a plurality of gate lines, and pixels which are arranged in matrix at each intersection between those lines to form a plurality of display lines; a sensing circuit, for sensing a pixel current in the pixels, integrating the pixel current to obtain a sensing voltage, and generating a sensing data based on the sensing voltage during a sensing operation period; and a compensation unit for calculating a compensation value for electrical characteristics of the pixels based on the sensing data.

15 Claims, 16 Drawing Sheets

(56) References Cited

FOREIGN PATENT DOCUMENTS

| | | | |
|---|---|---|---|
| TW | 200733036 | A | 9/2007 |
| TW | 201721622 | A | 6/2017 |
| WO | 2014/208458 | A | 12/2014 |

OTHER PUBLICATIONS

British Office Action, dated Jun. 12, 2018 for the British patent application No. 1721006.3.
Office Action with English translation dated Dec. 13, 2018 issued in the corresponding Japanese Application No. 2017-242556, pp. 1-8.
Office Action with English translation dated Dec. 26, 2018 issued in the corresponding Taiwanese Application No. 106145392, pp. 1-15.

* cited by examiner (A)
Before
Compensation (B)
After
Compensation

ELECTROLUMINESCENT DISPLAY DEVICE AND DRIVING METHOD OF THE SAME

CROSS-REFERENCE TO RELATED APPLICATION

This application claims the benefit of Korea Patent Application No. 10-2017-0095415 filed on Jul. 27, 2017, which is incorporated herein by reference for all purposes in its entirety as if fully set forth herein.

BACKGROUND

Field of the Disclosure

The present disclosure relates to a display device, and more particularly, to an electroluminescent display device and a driving method of the same.

Description of the Background

Electroluminescent display devices can be divided into inorganic light emitting display devices and organic light emitting display device by which material is used for an emission layer. Among them, an active matrix-type organic light emitting display device includes an organic light emitting diode (OLED) which emits light by itself and which is a typical example of the electroluminescent light emitting diode. In addition, the active matrix-type organic light emitting display device has advantages of quick response, high luminous efficiency and brightness, and a wide viewing angle.

The OLED, which is a self emitting element, includes an anode electrode, a cathode electrode and an organic compound layer positioned therebetween. The organic light emitting display device include pixels which are arranged in a matrix form, each pixel having an OLED and a driving Thin Film Transistor (TFT), and the organic light emitting display device adjust brightness of an image displayed by the pixels according to a gray level of image data. According to a voltage applied to a gate electrode and a source electrode of the driving TFT (the voltage which is referred to as a "gate-source voltage"), the driving TFT controls a driving current flowing in an OLED. According to the driving current, luminous power and brightness of the OLED is determined.

When a driving TFT operates in a saturation region, a driving current flowing between a drain and a source of the driving TFT is generally represented as below:

$$Ids=\frac{1}{2}*(u*C*W/L)*(Vgs-Vth)^2$$

Wherein u denotes electron mobility, C denotes a capacitance of a gate insulation layer, W denotes a channel width of the driving TFT, L denotes a channel length of the driving TFT, Vgs denotes a gate-source voltage of the driving TFT, and Vth denotes a threshold voltage of the driving TFT. Depending on a pixel structure, the gate source voltage Vgs of the driving TFT may be a differential voltage between a data voltage and a reference voltage. As the data voltage is an analog voltage corresponding to a gray level of image data and the reference voltage is a fixed voltage, the gate-source voltage Vgs of the driving TFT is programmed (or set) according to the data voltage. The driving current Ids is determined according to the programmed gate-source voltage Vgs.

Electrical characteristics of a driving TFT, such as the threshold voltage Vth and the electron mobility u, are factors that determine a driving current Ids, and thus, driving TFTs in all pixels should have the same electrical characteristics. However, the electrical characteristics may be different among pixels for various reasons, such as process variation and driving time increase. Such a deviation in electrical characteristic of a driving TFT may result in degrading image quality and reduce the lifespan of a device.

To compensate for a deviation in electrical characteristic, external compensation techniques are used. The external compensation techniques is implemented to sense a driving current Ids dependent upon a driving TFT and modulate data of an input image based on a sensing result so as to compensate for a deviation in electrical characteristics between pixels.

When electrical characteristics of a driving TFT in a specific pixel is being sensed, a driving Ids is not flowing into an OLED but applied to an external sensing circuit to thereby enable an OLED to emit light. This is to increase accuracy of sensing. As the electrical characteristics of a driving TFT are sensed with an OLED in a non-light emitting state, the sensing operation is performed in a specific time when an image is not displayed. In other words, the sensing operation is performed in a booting time which lasts until a screen turns on after system power is applied, or may be in a power-off time which lasts until the system power is off after the screen is turned off.

An existing electroluminescent display device splits an operation of sensing of a threshold voltage of a driving TFT and an operation of sensing of electron mobility of the driving TFT. After a threshold voltage of a driving TFT in every pixel of the existing electroluminescent display deice is sensed, electron mobility of a driving TFT in every pixel is sensed. If threshold voltage and electron mobility are sensed separately, it takes long time to perform a sensing operation and prolong a booting time and a power-off time, resulting in a degradation of performance of the display device.

SUMMARY

Accordingly, the present disclosure provides an electroluminescent display device and a driving method thereof, the display device which is for reducing a time for sensing electrical characteristics of a driving Thin Film Transistor (TFT).

One aspect of the present disclosure provides an electroluminescent display device which comprises a display panel, including a plurality of data lines, a plurality of sensing lines, a plurality of gate lines, and pixels which are arranged in matrix at each intersection between those lines to form a plurality of display lines; a sensing circuit, for sensing a pixel current in the pixels, integrating the pixel current to obtain a sensing voltage, and generating a sensing data based on the sensing voltage during a sensing operation period; and a compensation unit for calculating a compensation value for electrical characteristics of the pixels based on the sensing data.

Another aspect of the present disclosure provides a driving method for an electroluminescent display device, the electroluminescent display device comprising a display panel which includes a plurality of data lines, a plurality of sensing lines, a plurality of gate lines, and pixels which are arranged in matrix at each intersection between those lines to form a plurality of display lines, the method comprising: sensing a pixel current in the pixels during a sensing operation period; integrating the pixel current to obtain a sensing voltage, and generating a sensing data based on the sensing voltage; and calculating a compensation value for electrical characteristics of the pixels based on the sensing data.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principles of the disclosure.

In the drawings.

DETAILED DESCRIPTION

Figure 1:
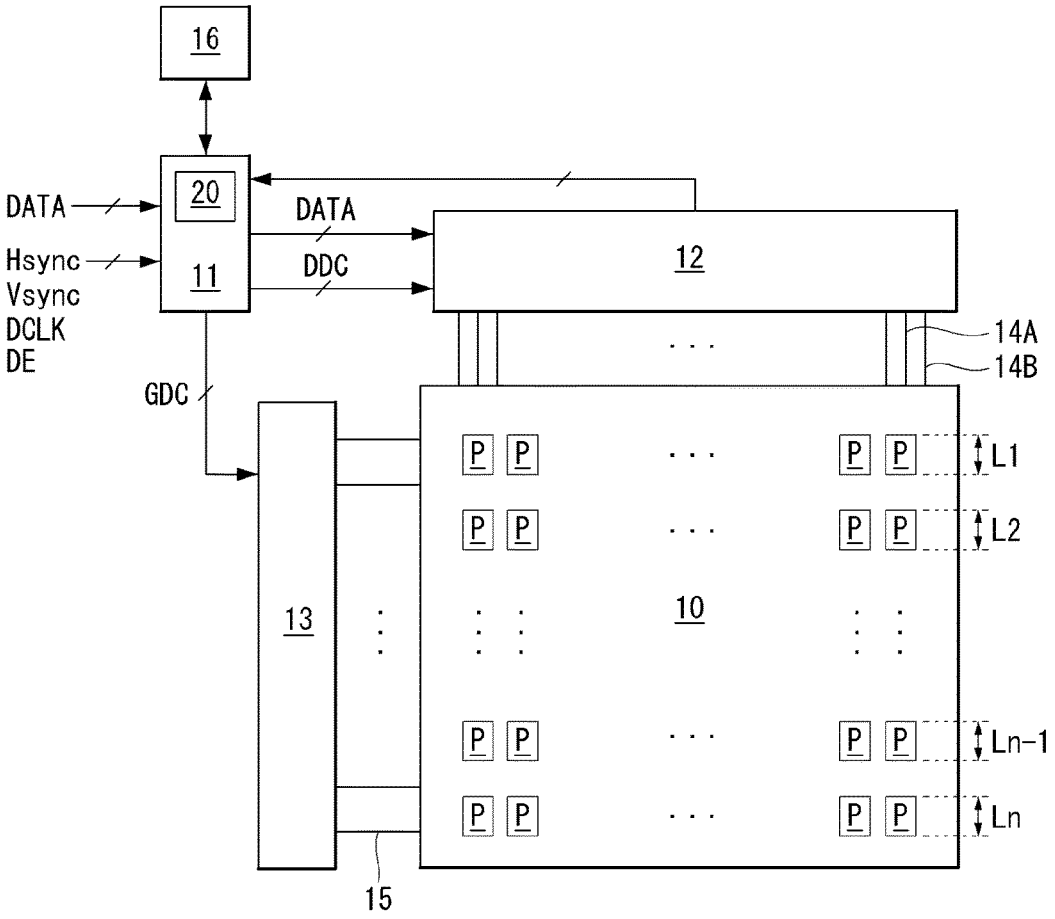
FIG. 1 is a block diagram illustrating an electroluminescent light emitting display device according to an aspect of the present disclosure.

Advantages and features of the present disclosure and methods to achieve them will become apparent from the descriptions of exemplary aspects herein below with reference to the accompanying drawings. However, the present disclosure is not limited to exemplary aspects disclosed herein but may be implemented in various different ways. The exemplary aspects are provided for making the disclosure of the present disclosure thorough and for fully conveying the scope of the present disclosure to those skilled in the art. It is to be noted that the scope of the present disclosure is defined only by the claims.

The figures, dimensions, ratios, angles, numbers of elements given in the drawings are merely illustrative and thus the present disclosure is not limited to what is shown in the drawings. Like reference numerals denote like elements throughout the descriptions. Further, in describing the present disclosure, descriptions on well-known technologies may be omitted in order not to obscure the gist of the present disclosure. It is to be noticed that the terms "comprising," "having," "including" and so on, used in the description and claims, should not be interpreted as being restricted to the means listed thereafter unless specifically stated otherwise. Where an indefinite or definite article is used when referring to a singular noun, e.g. "a," "an," "the," this includes a plural of that noun unless specifically stated otherwise.

In describing elements, they are interpreted as including error margins even without explicit statements.

In describing positional relationship, such as "an element A on an element B," "an element A above an element B," "an element A below an element Bi" and "an element A next to an element B," another element C may be disposed between the elements A and B unless the term "directly" or "immediately" is explicitly used.

The terms first, second, third and the like in the descriptions and in the claims are used for distinguishing between similar elements and not necessarily for describing a sequential or chronological order. These terms are used to merely distinguish one element from another. Accordingly, as used herein, a first element may be a second element within the technical idea of the present disclosure.

Like reference numerals denote like elements throughout the descriptions.

Features of various exemplary aspects of the present disclosure may be combined partially or totally. As will be clearly appreciated by those skilled in the art, technically various interactions and operations are possible. Various exemplary aspects can be practiced individually or in combination.

In the present disclosure, each of a pixel circuit and a gate driver formed on a substrate of a display panel may be implemented as a Thin Film Transistor (TFT) in the structure of an n-type or p-type Metal Oxide Semiconductor Field Effect Transistor (MOSFET). A TFT is a three-electrode element including a gate, a source, and a drain. The source is an electrode for supplying a carrier to the TFT. In the TFT, a carrier flows from the source. The drain is an electrode from which the carrier flows to the outside. That is, In a MOSFET, a carrier flow starts from the source to the drain. In the case of an n-type MOSFET (NMOS), a carrier is an electron, and thus a source voltage is lower than a drain voltage so that the electron flows from the source to the drain. In the case of the n-type MOSFET, a carrier flows from the source to the drain, and thus, a direction of currents is from the drain to the source. In the case of a p-type MOSFET (PMOS), a carrier is a hole, and thus, a source voltage is higher than a drain voltage so that the hole flows from the source to the drain. In the case of the p-type MOSFET, a hole flows from the source to the drain, and thus, a current flows from the source to the drain. The source and drain of an MOSFET is not fixed. For example, the source and drain of an MOSFET may be changed depending on an applied voltage.

In the following description, a gate on voltage is a voltage of a gate signal that enables turning on a TFT. A gate off voltage is a voltage of a gate signal that enables turning off a TFT. In an NMOS, the gate on voltage is a gate high voltage and the gate off voltage is a gate low voltage. In a PMOS, the gate on voltage is a gate low voltage and the gate off voltage is a gate high voltage.

Hereinafter, various aspects of the present disclosure will be described in detail with reference to the accompanying drawings. In the following aspects, an electroluminescent display device is described mainly about an organic light emitting display device including organic light emitting material. However, the technical idea of the present disclosure is not limited to the organic light emitting display device, but may be applied to an inorganic light emitting display device including an inorganic light emitting material.

Figure 2:
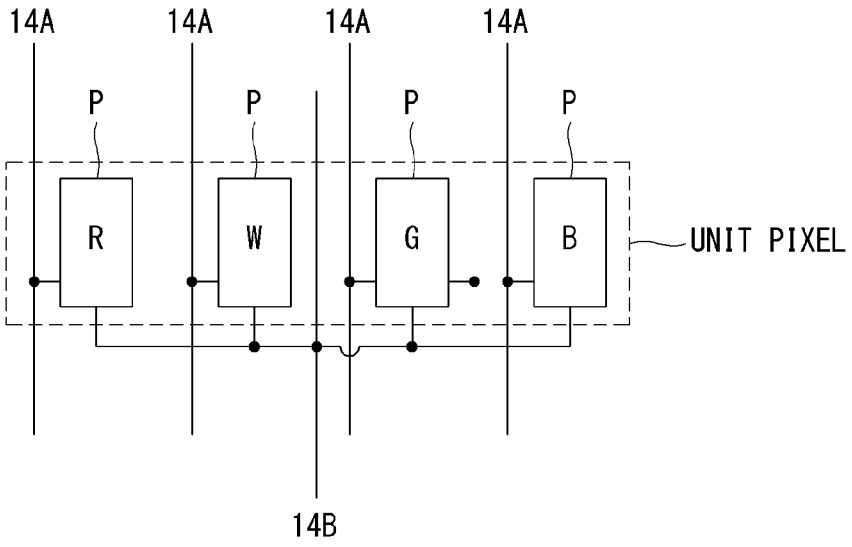
FIG. 2 is a diagram illustrating an example of connection between a sensing line and a unit pixel.
Figure 3:
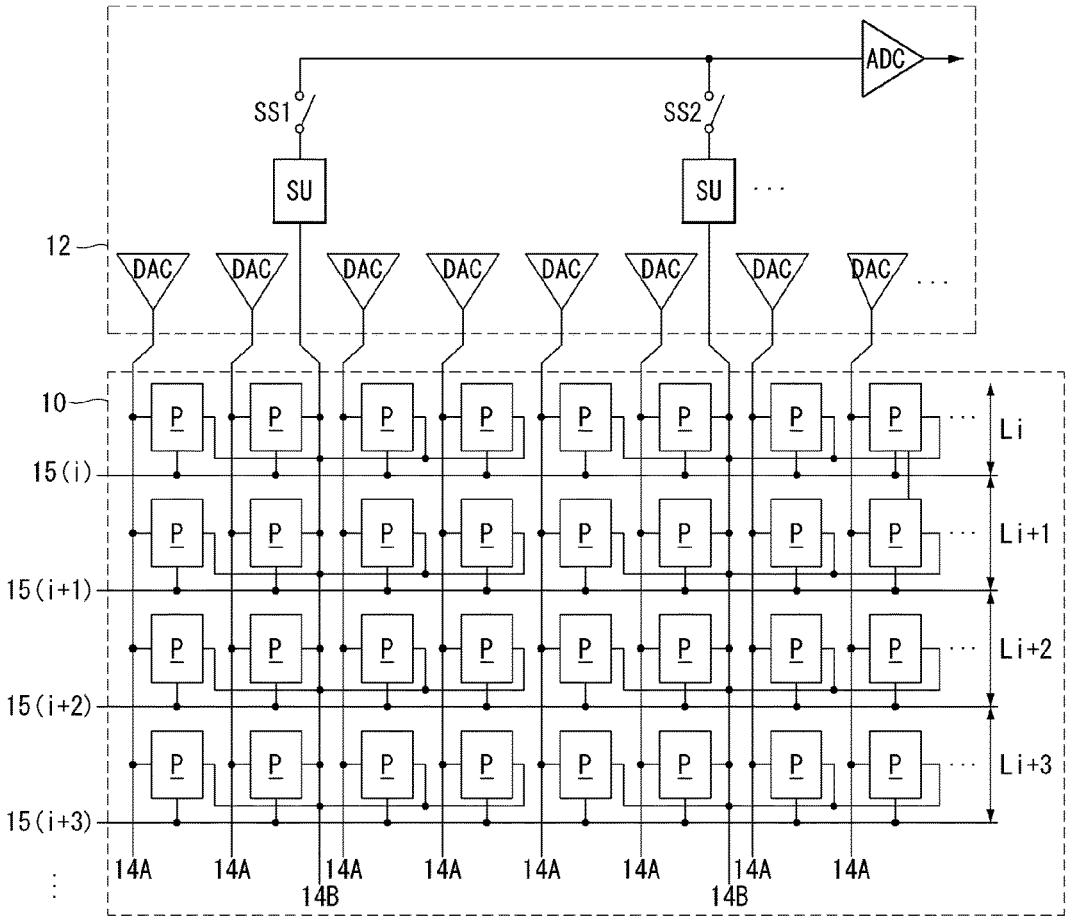
FIG. 3 is a diagram illustrating an exemplary configuration of a pixel array and a data driving circuit.

FIG. 1 is a block diagram illustrating an electroluminescent light emitting display device according to an aspect of the present disclosure. FIG. 2 is a diagram illustrating an example of connection between a sensing line and a unit pixel. FIG. 3 is a diagram illustrating an exemplary configuration of a pixel array and a data driving circuit.

Referring to FIGS. 1 to 3, an electroluminescent display device according to an aspect of the present disclosure may include a display panel 10, a timing controller 11, a data driving circuit 12, a gate driving circuit 13, and a memory 16.

The display panel 10 may include a plurality of data lines 14A, a plurality of sensing lines 14B, a plurality of gate lines 15, and pixels P which are arranged in a matrix form at each intersection between those lines to form a plurality of display lines L1 to Ln. Each of the display lines L1 to Ln does not indicate a physical signal line, but a group of pixels P which are arranged to be adjacent to each other along one horizontal direction (a direction in which a gate line extends).

Two or more pixels P connected to different data lines 14A may share the same sensing line 14B and the same gate line 15. For example, a plurality of pixels P neighboring in a horizontal direction and connected to the same gate line 15 in one unit pixel may be connected to the same sensing line 14B. The one unit pixel may include an R pixel of red, a W pixel of white, a G pixel of green, and a B pixel of blue, as illustrated in FIG. 2. In addition, although not illustrated in the drawings, one unit pixel may include an R pixel, a G pixel, and a B pixel. In a sensing line-sharing structure in which one sensing line 14B is arranged every three or four pixel columns, it is easy to secure an aperture ratio of a display panel. In the sensing line sharing structure, one sensing line 14B may be arranged for the plurality of data lines 14A. Meanwhile, the drawings shows the sensing line 14B is in parallel with the data line 14A, but it may be arranged to intersect with the data line 14A.

Each pixel P is supplied from a not-shown power generator with a high-potential driving voltage EVDD and a low-potential driving voltage EVSS. Each pixel P of the present disclosure may have a circuit structure suitable for sensing electrical characteristics of a driving element. However, there may be variations of the pixel structure in addition to the structure suggested in the aspects of the present disclosure. It should be noted that the technical idea of the present disclosure is not limited to connection configuration of the pixel structure. For example, each pixel P may include a plurality of switch elements and a storage capacitor in addition to a light emitting element and a driving element.

The timing controller 11 may temporally separate a sensing operation and a display operation by a control sequence. The sensing operation is an operation for sensing electrical characteristics of a driving element and updating a compensation value therefor. The display operation is an operation for writing data DATA of an input image, to which the compensation value has been applied, into the display panel 10 so as to display the image. Under the control of the timing controller 11, the sensing operation may be performed in a booting period, in a vertical blank period during the display operation, in a booting period before the display operation, or in a power-off period after the display operation. The vertical blank period is a period of time in which the input image data DATA is not written, and positioned between vertical active periods each corresponds to one frame. The booting period is a period of time which lasts until a screen turns on after system power is applied. The power-off period is a period of time which lasts until the system power is off after the screen is turned off.

Meanwhile, the sensing operation may be performed in an idle driving state in which a screen of the display device is turned off while system power is being applied. The idle driving state may indicate a stand-by mode, a sleep mode, and a low-power mode. According to a preset detection process, the timing controller 11 may detect the stand-by mode, the sleep mode, the low-power mode, and the like, and controls preparation for the sensing operation.

Based on timing signals received from a host system, such as a vertical synchronization signal Vsync, a horizontal synchronization signal Hsync, a dot clock signal DCLK and a data enable signal DE, the timing controller 11 may generate a data control signal DDC for controlling an operation timing of the data driving circuit 12 and a gate control signal GDC for controlling an operation timing of a gate driving circuit 13. The timing controller 11 may differently generate control signals DDC and GDC for a display operation, and control signals DDC and GDC for a sensing operation.

The gate control signal GDC includes a gate start pulse and a gate shift clock. The gate start pulse is applied to a gate stage, which generates a first output, and controls the gate stage. The gate shift clock is a clock signal which is input to every gate stage to shift a gate start pulse.

The data control signal DDC includes a source start pulse, a source sampling clock, and a source output enable signal. The source start pulse controls a data sampling start timing of the data driving circuit 12. The source sampling clock is a clock signal which controls a sampling timing of data with reference to a rising or falling edge. The source output enable signal controls an output timing of the data driving circuit 12.

The timing controller 11 may include the compensation unit 20. The compensation unit 20 calculates a compensation value for electrical characteristics of the pixels P based on sensing data received from a sensing circuit in the data driving circuit 12 during a sensing operation period, and stores the compensation value in the memory 16. The compensation value is a value used to compensate for a deviation in electrical characteristics of a driving element. In a display operation, the compensation unit 20 retrieves a compensation value from the memory 16, corrects image data DATA with the compensation value, and supplies the corrected image data DATA to the data driving circuit 12. The compensation value stored in the memory may be updated in each sensing operation, and accordingly, a deviation in electrical characteristics of a driving element may be compensated easily.

The data driving circuit 12 may include at least one data driver Integrated Circuit(IC). In the data driver IC, a plurality of digital-to-analog converters (DACs) respectively connected to the data lines 14A is embedded. In a display operation, the DACs of the data driver IC converts image data DATA into a data voltage for image display in response to a data timing control signal DDC applied from the timing controller 11, and supplies the data voltage to the data lines 14A. Meanwhile, in a sensing operation, the DACs of the data driver IC may sense a sensing data voltage in response to a data timing control signal DDC applied from the timing controller 11, and supplies the sensing data voltage to the data lines 14A.

The sensing operation is performed per pixel with reference to one sensing line 14B, and per display line with reference to all the sensing lines 14B. For example, while the i-th display line Li is sensed, other display lines Li+1 to Li+3 are not sensed. In addition, the sensing operation on the i-th display line Li is performed with respect to only some pixels of one color in the i-th display line Li, not all pixels in the i-th display line Li. Pixels of other colors may be sensed sequentially through an additional sensing operation, or may not be sensed.

In a sensing line sharing structure, a plurality of pixels P within a unit pixel shares the same sensing line 14B. Thus, in order to selectively sense only a pixel of a specific color within the unit pixel, it is necessary to allow a pixel current to flow only in the corresponding pixel. To this end, a sensing data voltage includes a turn-on data voltage and a turn-off data voltage. The turn-on data voltage is a voltage which is applied to a specific pixel to be sensed in a unit pixel, and which enables turning on a driving element. In the specific pixel to which the turn-on data voltage is applied in a sensing operation, a pixel current indicating electrical characteristics of the driving element flows. The turn-off data voltage is applied to other pixels not to be sensed in a unit pixel, and enables turning off a driving element. The pixel current does not flow in those pixels to which the turn-off data voltage is applied.

The data driver IC includes a sensing circuit for sensing a pixel current in the pixels P, integrating the pixel current to obtain a sensing voltage, and generating a sensing data based on the sensing voltage during a sensing operation period. The sensing circuit includes a plurality of sensing units SU and an analog-to-digital converter (ADC). Each sensing unit SU is connected to a different sensing line 14B, and the sensing units SU are connected to the ADC sequentially in a sampling order. Each sensing unit SU is implemented as a current integrator or a current-voltage converter which is similar to a current integrator. The ADC may convert a sensing voltage received from the sensing unit SU into sensing data, and output the sensing data to the compensation unit 20.

In a sensing operation, the gate driving circuit 13 may generate a gate signal based on a gate control signal GDC, and supplies the gate signal to gate lines 15(i) to 15(i+3) arranged in the display lines Li to Li+3 sequentially or non-sequentially. One line sensing ON time is determined by a gate signal that is applied in a sensing operation. One line sensing-on time is a time allocated to sense only pixels P of one specific color from among multiple colors arranged in one display line. The pixels of the one specific color may be pixels P of any one color from among R, G, B pixels, or may be pixels of any one color from among R, G, B, and W pixels. Thus, in order to sense all pixels of multiple colors arranged in one display line, one line sensing ON time may be needed three or four times. Meanwhile, in the case where the pixels P of the one specific color are sensed and pixels of colors other than the one specific color are not sensed, one line sensing ON time is needed just once, and therefore, it is possible to reduce a sensing time to ¼.

In a display operation, the gate driving circuit 13 may generate a gate signal based on a gate control signal GDC, and supply the gate signal to the gate lines 15(i) to 15(i+3) arranged in the display lines Li to Li+3 sequentially.

In this electroluminescent display device of the present disclosure, each sensing unit SU is implemented as a current-voltage converter to directly sense a pixel current flowing in each pixel P. As each sensing unit SU employs a current sensing method, it is possible to sense a micro-current of a low gray level and thus to perform sensing more quickly. Therefore, it is possible to increase sensitivity while reducing a sensing time. This will be described in more detail with reference to FIGS. 4 and 5.

In addition, as the electroluminescent display device of the present disclosure is able to reduce a sensing time by employing a current sensing method, it is possible to obtain electrical characteristics of pixels P of each color by performed the sensing with respect to pixels of multiple colors in a sequential manner on a color-by-color basis. This will be described in more detail with reference to FIGS. 6 to 8.

In addition, the electroluminescent display device of the present disclosure may obtain electrical characteristics of the pixels P of each color by performing the sensing with respect to only pixels P of one specific color from among the pixels P of multiple colors and not sensing pixels P of colors other than the one specific color. In doing so, it is possible to reduce a sensing time to ⅓ compared to when sensing pixels of three colors, and to ¼ compared to sensing pixels of four colors. This will be described in more detail with reference to FIGS. 9 to 14.

Figure 4:
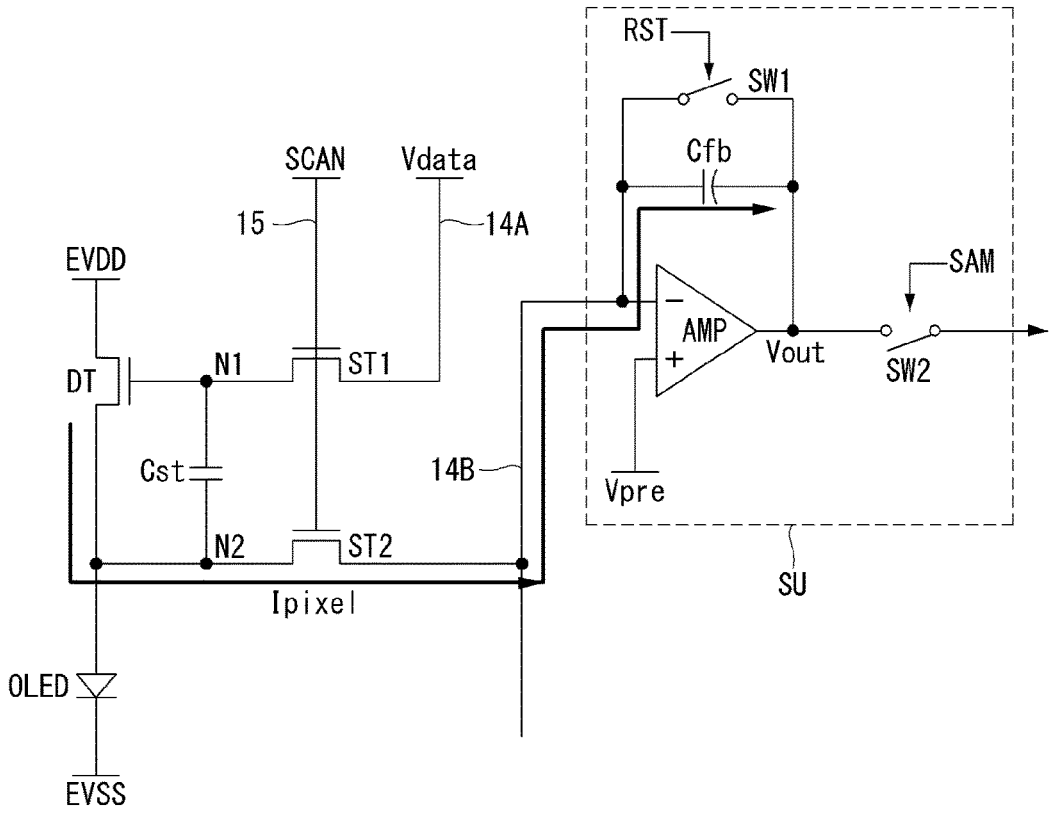
FIG. 4 is a diagram illustrating a pixel a configuration of a sensing unit according to an aspect of the present disclosure.
Figure 5:
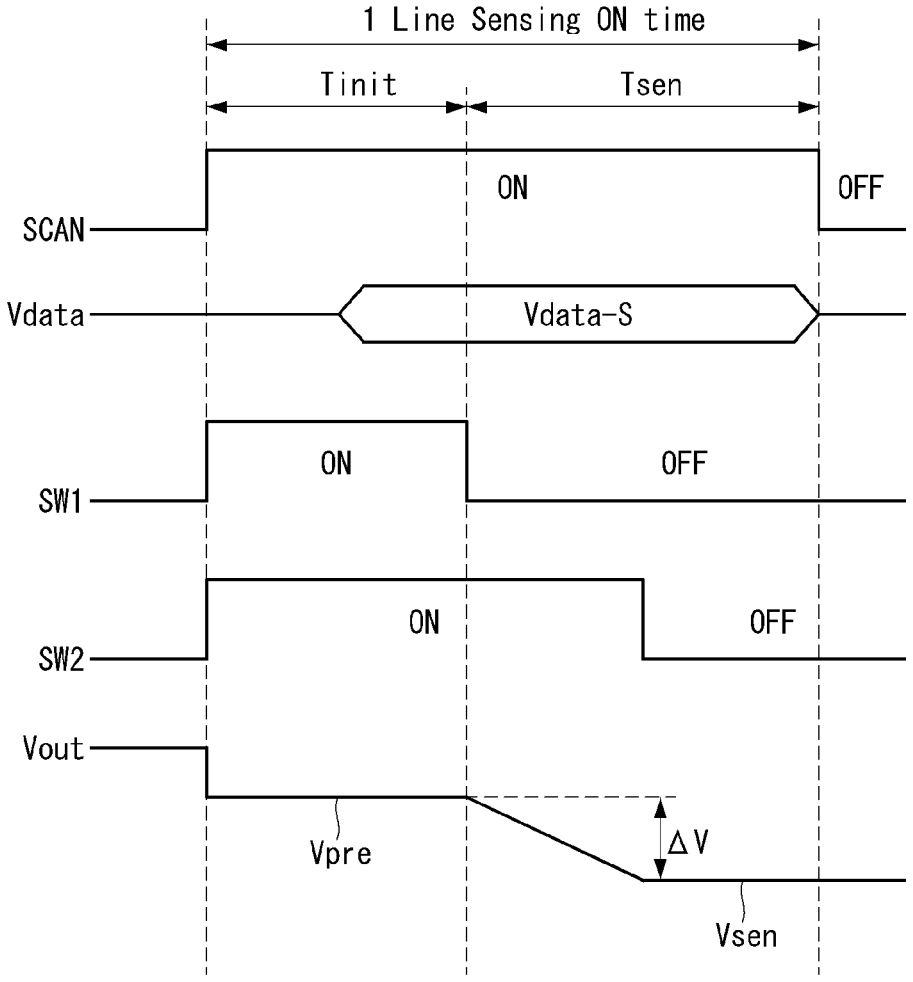
FIG. 5 is a diagram illustrating exemplary operation of a pixel and a sensing unit within one line sensing ON time.

FIG. 4 is a diagram illustrating a pixel configuration of a sensing unit according to an aspect of the present disclosure. FIG. 5 is a diagram illustrating exemplary operation of a pixel and a sensing unit within one line sensing ON time.

Referring to FIG. 4, a pixel P of the present disclosure may include an OLED, a driving TFT DT, a storage capacitor Cst, a first switch TFT ST1, and a second switch TFT ST2. The TFTs may be implemented as a p-type, an n-type, or a hybrid type which is a combination of a p-type and an n-type. In addition, a semiconductor layer of each TFT of the pixel P may include amorphous silicon, poly silicon, or an oxide.

The OLED is a light emitting element that emits light according to a pixel current. The OLED include an anode electrode connected to a second node N2, a cathode electrode connected to an input terminal of a low-potential driving voltage EVSS, and an organic compound layer positioned between the anode electrode and the cathode electrode.

The driving TFT DT is a driving element that generates a pixel current Ipixel depending on a gate-source voltage Vgs. When a source potential of the driving TFT DT is higher than an operating point voltage of the OLED, the pixel current Ipixel is applied to the OLED so as to allow the OLED to emit light. When a source potential of the driving TFT DT is lower than an operating point voltage of the OLED, the pixel current Ipixel is applied not to the OLED, but to the sensing unit SU. The driving TFT DT includes a gate electrode connected to a first node N1, a drain electrode connected to a high-potential driving voltage EVDD, and a source electrode connected to the second node N2.

The storage capacitor Cst is connected between the first node N1 and the second node N2. The storage capacitor Cst maintains the gate-source voltage Vgs of the driving TFT DT at a constant level for a predetermined period of time.

The first switch TFT ST1 applies a data voltage Vdata of the data line 14A to the first node N1 in response to a gate signal SCAN. The first switch TFT ST1 includes a gate electrode connected to the gate line 15, a drain electrode connected to the data line 14A, and a source electrode connected to the first node N1.

The second switch TFT ST2 turns on/off a current flow between the second node N2 and the sensing line 14B in response to a gate signal SCAN. The second switch TFT ST2 includes a gate electrode connected to the gate line 15, a drain electrode connected to the sensing line 14B, and a source electrode connected to the second node N2.

The sensing unit SU according to the present disclosure includes: an inverting input terminal (−) which is connected to the sensing line 14B and receives a pixel current Ipixel of a driving TFT from the sensing line 14B; a non-inverting input terminal (+) which receives a reference voltage Vpre; an amplifier AMP which includes an output terminal that outputs a sensing voltage Vsen (i.e., Vout); an integrating capacitor Cfb connected between the inverting input terminal (−) and the output terminal of the amplifier AMP; and a first switch SW1 connected to both ends of the integrating capacitor Cfb. The first switch SW1 is turned on/off by a reset signal RST. In addition, the sensing unit of the present disclosure further includes a second switch SW2 that is switched on/off by a sampling signal SAM.

FIG. 5 illustrates a waveform for sensing each pixel within one line sensing ON time which is defined as an on-pulse section of a sensing gate signal SCAN for sensing pixels of one specific color in one display line. Referring to FIG. 5, the sensing operation period includes an initialization period Tinit and a sensing period Tsen.

In the initialization period Tinit, the first switch SW1 is turned on and the amplifier AMP operates as a unit gain buffer having a gain of 1. In the initialization period Tinit, the input terminals (+, −) and the output terminal of the amplifier AMP, and the sensing line 14B are all initialized to the reference voltage Vpre.

In the initialization period Tinit, the second switch TFT ST2 is turned on to initialize the second node N2 to the reference voltage Vpre. In the initialization period Tinit, the first switch TFT ST1 is turned on to apply a sensing data voltage Vdata-S to the first node N1 through the data line 14A. Accordingly, a pixel current Ipixel corresponding to a potential difference (Vdata-S)-Vpre between the first node N1 and the second node N2 flows in the driving TFT DT. However, the amplifier AMP continuously operates as a unit gain buffer in the initialization period Tinit, and thus, an electric potential Vout of the output terminal thereof is maintained at the reference voltage Vpre.

As the first and second switch TFTs ST1 and ST2 remain turned-on and the fist switch SW1 is turned off in the sensing period Tsen, the amplifier AMP operates as a current integrator to integrate the pixel current Ipixel flowing in the driving TFT DT, to output the sensing voltage Vsen. In the sensing period Tsen, due to the pixel current Ipixel flowing into the inverting input terminal (−) of the amplifier AMP, a potential difference between both ends of the integrating capacitor Cfb increases when a sensing time proceeds, that is, when an accumulated amount of current increases. However, a short occurs between the inverting input terminal (−) and the non-inverting input terminal (+) through a virtual ground due to characteristics of the amplifier AMP, and thus, a potential difference therebetween is 0. Accordingly, a potential of the inverting input terminal (−) in the sensing period Tsen is maintained at the reference voltage Vpre, regardless of an increased potential difference between both ends of the integrating capacitor Cfb. Instead, a potential Vout of the output terminal of the amplifier AMP is reduced to correspond to the potential difference between both ends of the integrating capacitor Cfb. Based on this principle, the pixel current Ipixel inflowing via the sensing line 14B is accumulated as an integrated value Vsen, which is a voltage value, through the integrating capacitor Cfb. A descent gradient of an output value Vout of the current integrator increases more if the pixel current Ipixel inflowing via the sensing line 14B has a great value. Thus, the size of the sensing voltage Vsen is reduced if the pixel current Ipixel has a great value. In other words, a voltage difference AV between the reference voltage Vpre and the sensing voltage Vsen increases in proportion to the pixel current Ipixel. When the second switch SW2 remains turned on in the sensing period Tsen, the sensing voltage Vsen is stored in a sampling circuit (not shown) and then input to the ADC in the data driving circuit 12. The sensing voltage Vsen is converted into digital sensing data by the ADC and then output to the compensation unit.

A capacitance of the integrating capacitor Cfb included in the current integrator is millions of times smaller than a capacitance of a line capacitor (a parasitic capacitor) existing in the sensing line 14B. Thus, the current sensing method according to the present disclosure dramatically reduces a time required to reach a sensing voltage Vsen, compared to an existing voltage sensing method which includes only a sampling circuit. In the existing voltage sensing method, when sensing a threshold voltage of a driving TFT DT, it takes long time until a source voltage of the driving TFT is saturated. On the other hand, in the current sensing method according to the present disclosure, when sensing a threshold voltage and mobility, it is possible to integrate and sample a pixel current Ipixel of a driving TFT in a short period of time by sensing a current, and therefore, it is possible to reduce a sensing time significantly.

Figure 6:
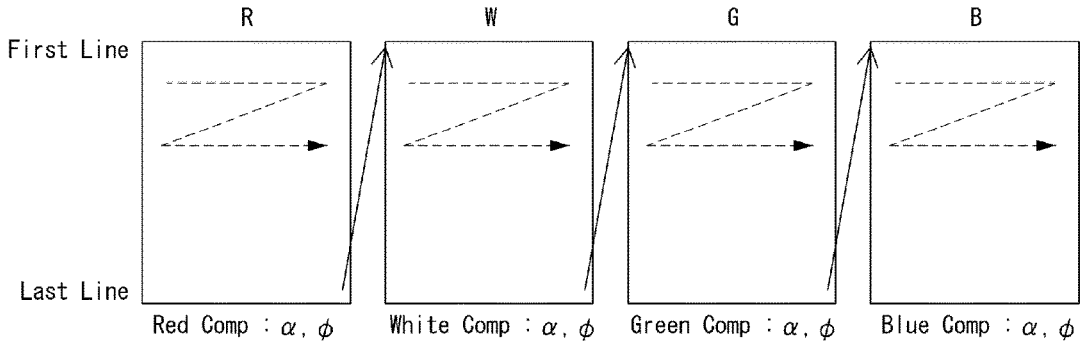
FIG. 6 illustrates a multi-color sequential sensing method according to an aspect of the present disclosure.
Figure 7:
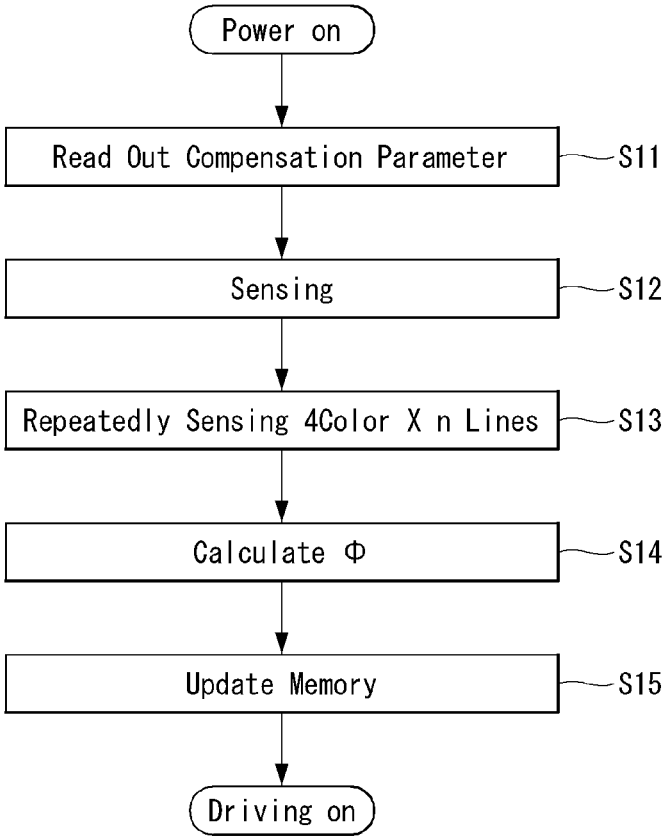
FIG. 7 illustrates a procedure of sensing and compensating for a threshold voltage of a driving element according to the multi-color sequential sensing method.
Figure 8:
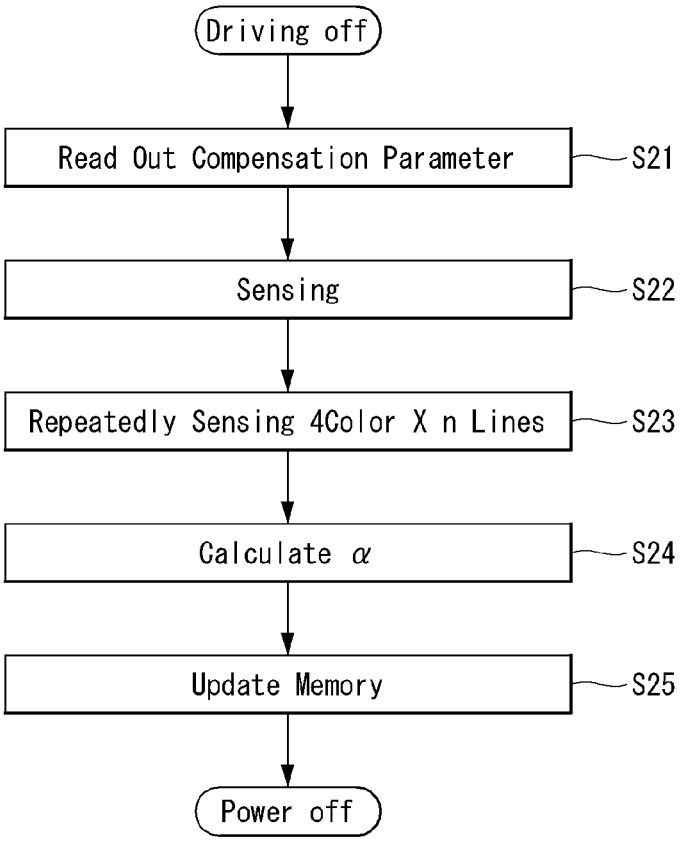
FIG. 8 illustrates a procedure of sensing and compensating for electron mobility of a driving element according to the multi-color sequential sensing method.

FIG. 6 illustrates a multi-color sequential sensing method according to an aspect of the present disclosure. FIG. 7 illustrates a procedure of sensing and compensating for a threshold voltage of a driving element according to the multi-color sequential sensing method. FIG. 8 illustrates a procedure of sensing and compensating for electron mobility of a driving element according to the multi-color sequential sensing method.

Referring to FIGS. 6 to 8, the multi-color sequential sensing method according to an aspect of the present disclosure splits an operation of sensing a threshold voltage of a driving TFT DT and an operation of sensing electron mobility of the driving TFT DT. Even though an operation of sensing a threshold voltage and an operation of sensing electron mobility are split, the multi-color sequential sensing method according to an aspect of the present disclosure is able to reduce a sensing time by employing a current sensing method.

Referring to FIG. 6, for example, when one unit pixel includes pixels of four colors (R pixels, W pixels, G pixels, and B pixels), the multi-color sequential sensing method according to an aspect of the present disclosure is implemented such that a threshold voltage of every R pixel is sequentially sensed using one line sensing ON time allocated to each display line, a threshold voltage of every W pixel is sequentially sensed using one line sensing ON time allocated to each display line, a threshold voltage of every G pixel is sequentially sensed using one line sensing ON time allocated to each display line, and a threshold voltage of every B pixel is sequentially sensed using one line sensing ON time allocated to each display line.

To this end, the multi-color sequential sensing method according to an aspect of the present disclosure is implemented to retrieve a threshold voltage-related compensation parameter from the memory, as shown in FIG. 7, and generates first to fourth sensing data voltages by applying the threshold voltage-related compensation parameter. The first sensing data voltage is generated at a turn-on level only when sensing a threshold voltage of R pixels, the second sensing data voltage is generated at a turn-on level only when sensing a threshold voltage of W pixels, the third sensing data voltage is generated at a turn-on level only when sensing a threshold voltage of G pixels, and the fourth sensing data voltage is generated at a turn-on level only when sensing a threshold voltage of B pixels (S11, S12).

The multi-color sequential sensing method according to an aspect of the present disclosure is implemented to sense a threshold voltage of pixels of the four colors according to the first to fourth sensing data voltages in a sequence on a color-by-color basis, with respect to each of the display lines L1 to Ln. Thus, the multi-color sequential sensing method repeatedly senses n number of display lines four times (S13).

The multi-color sequential sensing method according to an aspect of the present disclosure is implemented to calculate a threshold voltage compensation value Φ based on a result of sensing a threshold voltage of the R pixels, calculates a threshold voltage compensation value Φ based on a result of sensing a threshold voltage of the W pixels, calculates a threshold voltage compensation value Φ based on a result of sensing a threshold voltage of the G pixels, and calculates a threshold voltage compensation value Φ based on a result of sensing a threshold voltage of the B pixels (S14). Then, the threshold voltage compensation value Φ for each of the R, W, G, and B pixels are stored in the memory, so as to update the threshold voltage-related compensation parameter in the memory with the threshold voltage compensation value Φ (S15).

Meanwhile, referring to FIG. 6, the multi-color sequential sensing method according to an aspect of the present disclosure implemented to sequentially sense electron mobility of all R pixels on a display line unit basis, sequentially sense electron mobility of all W pixels on a display line unit basis, sequentially sense electron mobility of all G pixels on a display line unit basis, and sequentially sense electron mobility of all B pixels on a display line unit basis. To this end, the multi-color sequential sensing method according to an aspect of the present disclosure is implemented to retrieve an electron mobility-related compensation parameter from the memory and generate fifth to eighth sensing data voltages by applying the electron mobility-related compensation parameter. The fifth sensing data voltage is generated at a turn-on level only when sensing electron mobility of R pixels, the sixth sensing data voltage is generated at a turn-on level only when sensing electron mobility of W pixels, the seventh sensing data voltage is generated at a turn-on level only when sensing electron mobility of G pixels, and the eighth sensing data voltage is generated at a turn-on level only when sensing electron mobility of B pixels (S21, S22).

The multi-color sequential sensing method according to an aspect of the present disclosure is implemented to sequentially sense electron mobility of pixels of four colors according to the fifth to eighth sensing data voltages on a color-by-color basis, with respect to each of the display lines L1-Ln. It means that the multi-color sequential sensing method repeatedly senses n number of display lines four times (S23).

The multi-color sequential sensing method according to an aspect of the present disclosure is implemented to calculate an electron mobility compensation value α for each R pixel based on a result of sensing electron mobility of the R pixels, calculate an electron mobility compensation value α for each W pixel based on a result of sensing electron mobility of the W pixels, calculate an electron mobility compensation value α for each G pixel based on a result of sensing electron mobility of the G pixels, and calculate an electron mobility compensation value α for each B pixel based on a result of sensing electron mobility of the B pixels (S24). Then, the electron mobility compensation value a for each of the R, W, G, and B pixels is stored in the memory, so as to update the electron mobility-related compensation parameter in the memory with the electron mobility compensation value α (S25).

Figure 9:
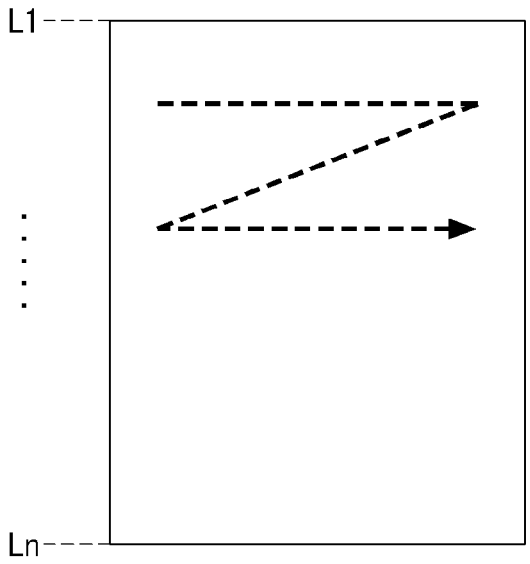
FIG. 9 illustrates a one-color sensing method according to another aspect of the present disclosure.
Figure 10:
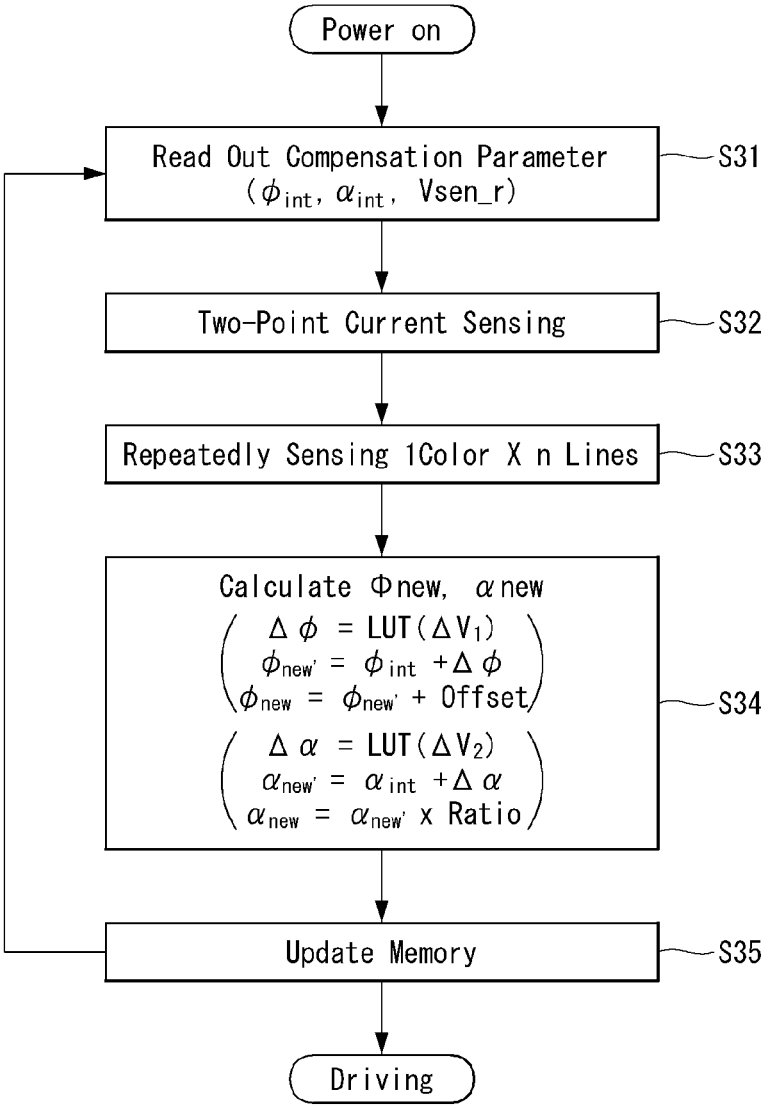
FIG. 10 is a diagram illustrating a procedure of sensing and compensating for a threshold voltage and electron mobility of a driving element according to the one-color sensing method.
Figure 11:
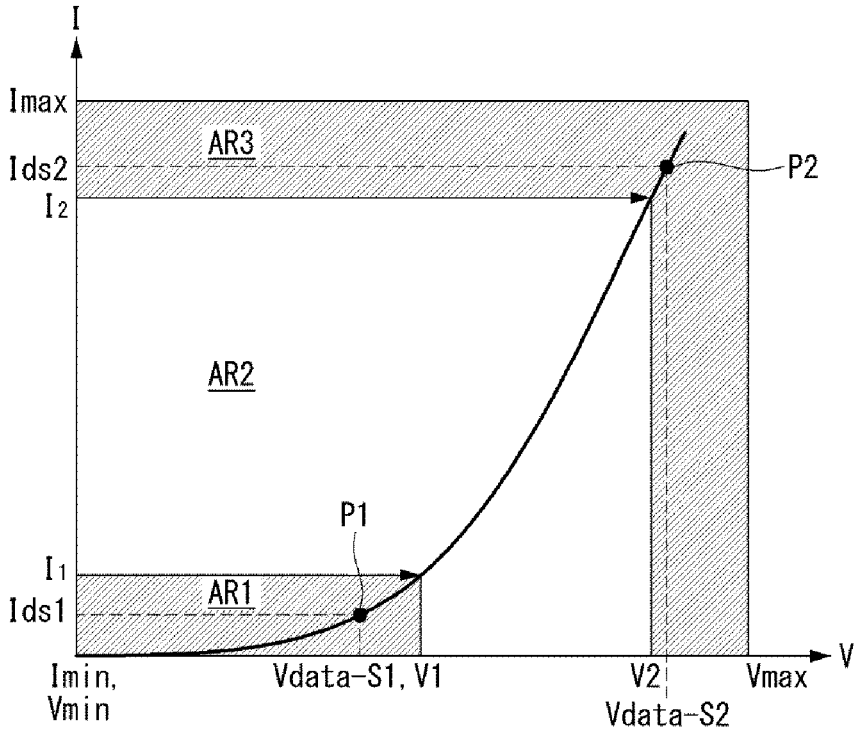
FIG. 11 is a diagram illustrating a two-point current sensing scheme to continuously sense a threshold voltage and electron mobility of a driving element.
Figure 12:
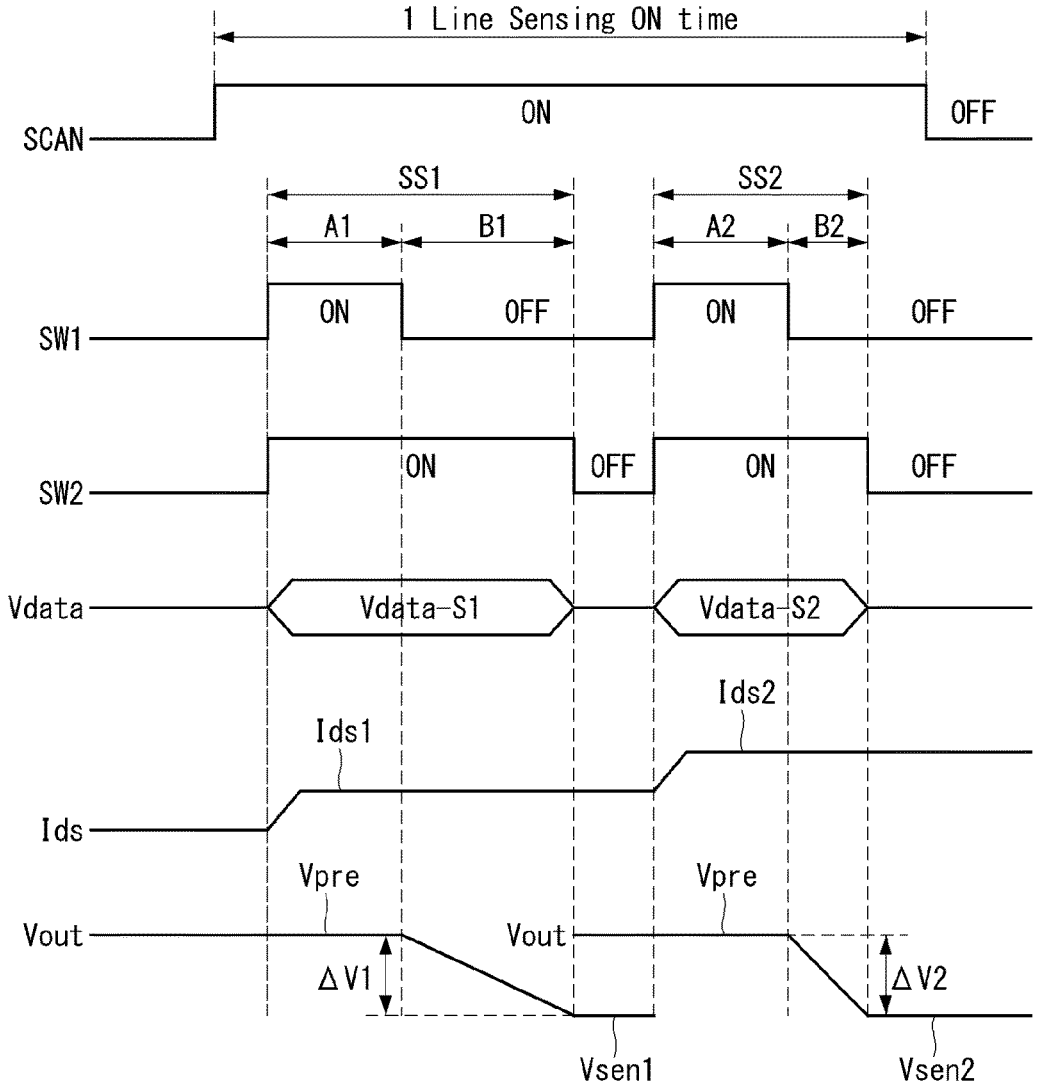
FIG. 12 is a diagram illustrating an example of operation of a pixel and a sensing unit within one line sensing ON time when two-point current sensing is performed with respect to only pixels of one color.
Figure 13:
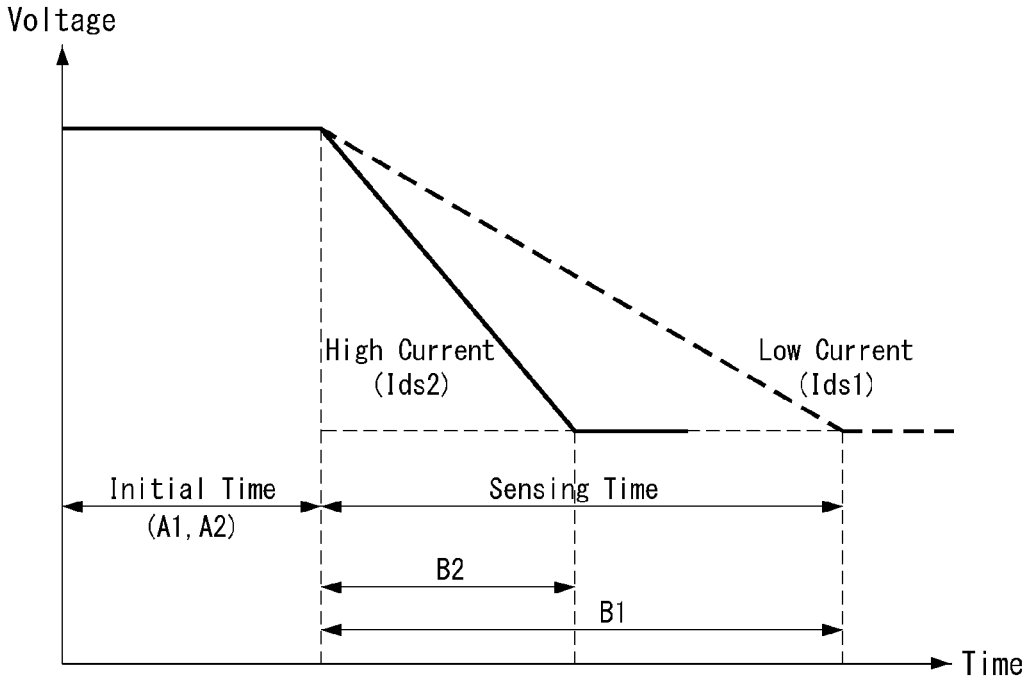
FIG. 13 is a diagram illustrating the case where a low gray-level current sensing period is set longer than a high gray-level current sensing period when two-point current sensing is performed.
Figure 14:
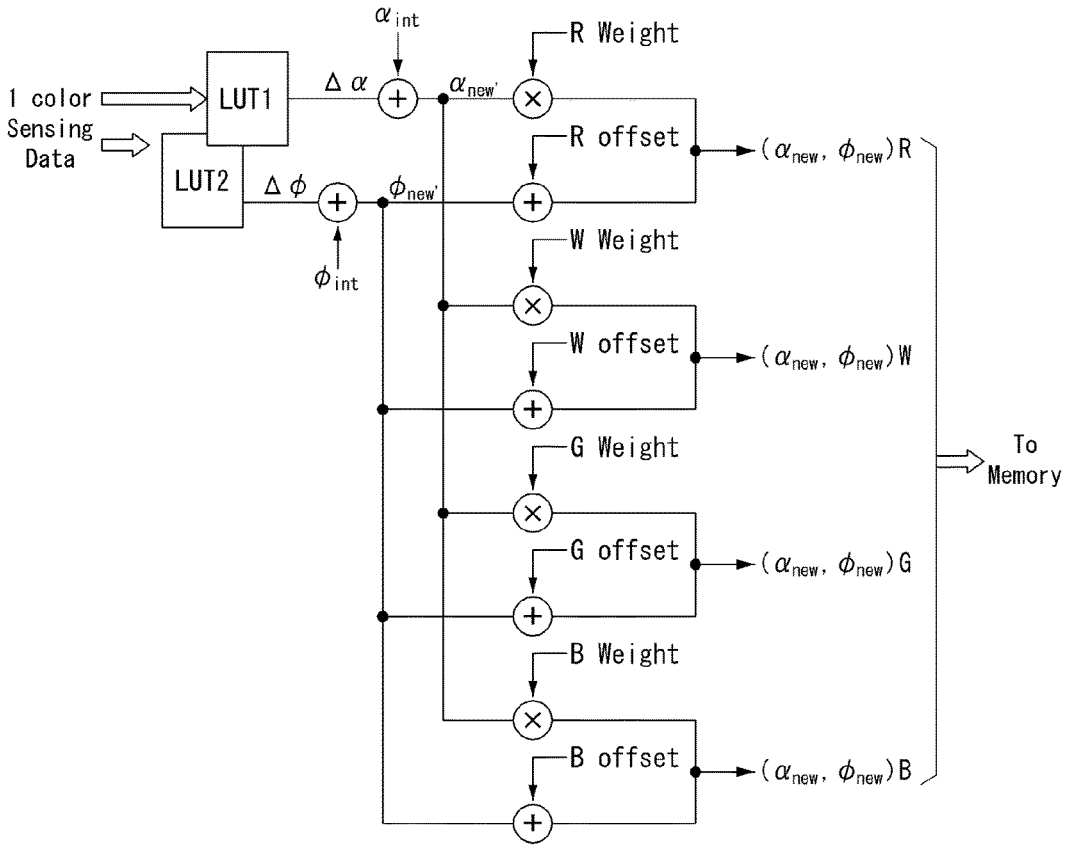
FIG. 14 is a diagram illustrating configuration of a compensation unit that calculates a threshold voltage compensation value and an electron mobility compensation value of each pixel based on two-point current sensing data.

FIG. 9 illustrates a one-color sensing method according to another aspect of the present disclosure. FIG. 10 is a diagram illustrating a procedure of sensing and compensating for a threshold voltage and electron mobility of a driving element according to the one-color sensing method. FIG. 11 is a diagram illustrating a two-point current sensing scheme to continuously sense a threshold voltage and electron mobility of a driving element. FIG. 12 is a diagram illustrating an example of operation of a pixel and a sensing unit within one line sensing ON time when two-point current sensing is performed with respect to only pixels of one color. FIG. 13 is a diagram illustrating the case where a low gray-level current sensing period is set longer than a high gray-level current sensing period when two-point current sensing is performed. FIG. 14 is a diagram illustrating configuration of a compensation unit that calculates a threshold voltage compensation value and an electron mobility compensation value of each pixel based on two-point current sensing data.

Referring to FIGS. 9 to 14, the one-color sensing method according to another aspect of the present disclosure is implemented to sense electrical characteristics of each driving TFT DT in only pixels of one specific color from among four colors and does not sense pixels of other colors. In doing so, it is possible to reduce a sensing time to ¼, compared to the above-described multi-color sequential sensing method.

In addition, the one-color sensing method according to another aspect of the present disclosure is implemented to sense pixels P of one specific color, and continuously senses a threshold voltage and an electron mobility of a driving TFT included in each pixels of the one specific color within one line sensing ON time by employing a two-point current sensing scheme. In doing so, it is possible to further reduce a sensing time.

Referring to FIG. 9, the one-color sensing method according to another aspect of the present disclosure is implemented to sense only pixels of one specific color from among four colors in one display line each time within one line sensing On time. The one-color sensing method according to another aspect of the present disclosure employs a two-point current sensing scheme to sense a threshold voltage and electron mobility of a driving TFT within one line sensing ON time.

To this end, the one-color sensing method according to another aspect of the present disclosure is implemented to retrieve a threshold voltage-related compensation parameter and an electron mobility-related compensation parameter from the memory (S31), as shown in FIG. 10. The threshold voltage-related compensation parameter and the electron mobility-related compensation parameter may include an initial threshold voltage compensation value (I)Φint, an initial electron mobility compensation value αint, and a reference sensing value Vsen_r. The initial threshold voltage compensation value Φint and the initial electron mobility compensation value αint are compensation values of an initial state which indicates a state before electrical characteristics of a driving TFT are changed, that is, default compensation values. The reference sensing value Vsen_r is a digital signal into which the reference voltage Vpre shown in FIGS. 4 and 5 is converted.

Referring to FIG. 10, the one-color sensing method according to another aspect of the present disclosure is implemented to perform a two-point sensing on the pixels of one specific color in one display line, to obtain a first sensing data for sensing the threshold voltage and a second sensing data for sensing the electron mobility (S32), by using a sensing unit SU and a pixel circuit shown in FIG. 4.

The two-point current sensing scheme is a sensing method using a first point P1 in a low gray level area AR1 and a second point P2 in a high gray level area AR3 over a voltage (V)-current (I) curve, as illustrated in FIG. 11. The low gray level area AR1 is defined by a voltage section between Vmin and V1 and a current section between Imin and I1. The high low gray level area AR3 is defined by a voltage section between V2 and Vmax and a current section between I2 and Imax. In addition, a middle gray level area AR2 between the low gray level area AR1 and the high gray level area AR3 is defined by a voltage section between V1 and V2 and a current section between I1 and I2.

In the low gray level area AR1, a threshold voltage variation has more influence than an electron mobility variation. On the other hand, in the high gray level area AR3, an electron mobility variation has more influence than a threshold voltage variation. In other words, the low gray level area AR1 is relatively advantageous in sensing a threshold voltage variation, whereas the high gray level area AR3 is relatively advantageous in sensing an electron mobility variation.

The one-color sensing method according to another aspect of the present disclosure is implemented to generate a first sensing data voltage Vdata-S1 corresponding to the first point P1 and a second sensing data voltage Vdata-S2 corresponding to the second point P2 for the purpose of two-point current sensing. The first sensing data voltage Vdata-S1 is for sensing a threshold voltage of pixels of one specific color, and the second sensing data voltage Vdata-S2 is for sensing electron mobility of pixels of one specific color. The first sensing data voltage Vdata-S1 and the second sensing data voltage Vdata-S2 are turn-on driving voltages which enables turning on a driving TFT. In other words, the driving TFT may generate a first pixel current Ids1 in response to the first sensing data voltage Vdata-S1, and a second pixel current Ids2 in response to the second sensing data voltage Vdata-S2. The second sensing data voltage Vdata-S2 is at a voltage level higher than a voltage level of the first sensing data voltage Vdata-S1. In addition, the second pixel current Ids2 is greater than the first pixel current Ids1.

Referring to FIG. 10, the one-color sensing method according to another aspect of the present disclosure is implemented to repeatedly perform two-point current sensing only with respect to pixels of one specific color with respect to each of the display lines L1 to Ln, to obtain a first sensing data for sensing the threshold voltage and a second sensing data for sensing the electron mobility (S33). In other words, the one-color sensing method according to another aspect of the present disclosure is implemented to continuously sense the first pixel current Ids1 and the second pixel current Ids2 with respect to pixels of one specific color within one line sensing ON time.

To this end, as illustrated in FIG. 12, in the one-color sensing method according to another aspect of the present disclosure, one line sensing ON time may include a first section SS1 for sensing a threshold voltage and a second section SS2 for sensing electron mobility.

Referring to FIG. 12, the first section SS1 is a section in which the sensing unit SU senses the first pixel current Ids1 according to the first sensing data voltage Vdata-S1. The first section SS1 includes a first initialization period A1 and a first sensing period B1.

During the first initialization period A1, the first and second switch TFTs ST1 and ST2 and the first and second switches SW1 and SW2 are all turned on, whereas the input terminals (+, −) and the output terminal of the amplifier AMP, the sensing line 14B, and the second node N2 of the pixel circuit are all initialized to the reference voltage Vpre. During the first initialization period A1, the first pixel current Ids1 flows in all pixels of one specific color in a corresponding display line. During the first initialization period A1, the amplifier AMP continuously operates as a unit gain buffer, and thus, an electronic potential of the output terminal is maintained at the reference voltage Vpre.

During the first sensing period B1, the first switch SW1 is inverted into a turn-off state, and the first and second switch TFTs ST1 and ST2 and the second switch SW2 remain in a turn-on state. During the first sensing period B1, the amplifier AMP operates as a current integrator to integrate the first pixel current Ids1 which flows in the pixels of the one specific color and which inflows through the sensing line 14B. During the first sensing period B1, the sensing unit SU integrates the first pixel current Ids1 to output a first sensing voltage Vsen1. The first sensing voltage Vsen1 is converted into first sensing data by the ADC and then the first sensing data is output to the compensation unit 20.

Referring to FIG. 12, the second section SS2 is a section in which the sensing unit SU senses the second pixel current Ids2 according to the second sensing data voltage Vdata-S2. The second section SS2 includes a second initialization period A2 and a second sensing period B2.

During the second initialization period A2, the first and second switch TFTs ST1 and ST2 and the first and second switches SW1 and SW2 are all turned on, whereas the input terminals (+, −) and the output terminal of the amplifier AMP, the sensing line 14B, and the second node N2 of the pixel circuit are all initialized to a reference voltage Vpre. During the second initialization period A2, the second pixel current Ids2 flows in all pixels of one specific color in a corresponding display line. During the second initialization period A2, the AMP continuously operates as a unit gain buffer, and thus, an electronic potential Vout of the output terminal is maintained at the reference voltage Vpre.

During the second sensing period B2, the first switch SW1 is inverted into a turn-off state, and the first and second switch TFTs ST1 and ST2 and the second switch SW2 remain in a turn-on state. During the second sensing period B2, the amplifier AMP operates as a current integrator to integrate the second pixel current Ids2 which flows in the pixels of the one specific color and which inflows through the sensing line 14B. During the second sensing period B2, the sensing unit SU integrates the second pixel current Ids2 to output a second sensing voltage Vsen2. The second sensing voltage Vsen2 is converted into second sensing data by the ADC and then the second sensing data is output to the compensation unit 20.

The first section SS1 and the second section SS2 continue within one line sensing ON time. The first section SS1 is for sensing a relatively small current, compared to the second section SS2. Thus, in order to increase sensing accuracy, the first section SS1 needs to be longer than the second section SS2. In other words, as illustrated in FIG. 13, the first sensing period B1 for sensing the first pixel current Ids1 needs to be longer than the second sensing period B2 for sensing the second pixel current Ids2.

Referring to FIG. 10, the one-color sensing method according to another aspect of the present disclosure is implemented to calculate a threshold voltage compensation value Φnew for a driving TFT between pixels of one specific color and pixels of other colors based on first sensing data which is acquired with respect to the pixels of the one specific color. In addition, the present disclosure calculates an electron mobility compensation value αnew for a driving TFT between pixels of one specific color and pixels of other colors based on second sensing data which is acquired with respect to the pixels of the one specific color (S34).

To this end, the compensation unit 20 of the present disclosure derives a threshold voltage variation ΔΦ dependent upon the first sensing data, and calculates threshold voltage compensation values RΦnew, WΦnew, GΦnew, BΦnew for driving TFTs in pixels of each color by adding the threshold voltage variation ΔΦ to an initial threshold voltage compensation value Φint and then adding its sum to an R/W/G/B offset for each color to the threshold voltage variation ΔΦ. In this case, the compensation unit 20 derives the threshold voltage variation ΔΦ using a first lookup table LUT1. By setting a difference ΔV1 between the first sensing data and the first lookup table as an address to read, the compensation unit 20 may read the threshold voltage variation ΔΦ from the first lookup table LUT1. In FIGS. 10 to 14, Φnew' is a sum of the threshold voltage variation ΔΦ and the initial threshold voltage compensation value Φint.

In addition, as illustrated in FIG. 14, the compensation unit 20 of the present disclosure derives an electron mobility variation Δα dependent upon the second sensing data, and calculates electron mobility compensation values Rαnew, Wαnew, Gαnew, Bαnew for driving TFTs in pixels of each color by adding the electron mobility variation Δα to an initial electron mobility compensation value αint and then multiplying its sum by a gain value Weight for each color R/W/G/B. In this case the compensation unit 20 derives the electron mobility variation Δα using a second lookup table LUT2. By setting a different ΔV2 between the sensing data and a reference sensing value Vsen_r to be an address to read, the compensation unit 20 may read the electron mobility variation Δα from the second lookup table LUT2. In FIGS. 10 to 14, αnew' indicates a sum of the electron mobility variation Δα and the initial electron mobility compensation value αint.

Referring to FIG. 10, the one-color sensing method according to another aspect of the present disclosure is implemented to update the threshold voltage-related compensation parameters in the memory with the threshold voltage compensation values R101 new, WΦnew, GΦnew, BΦnew for driving TFTs between pixels of one specific color and pixels of other colors, and update the electron mobility-related compensation parameters in the memory with the electron mobility compensation values Rαnew, Wαnew, Gαnew, Bαnew for driving TFTs between pixels of one specific color and pixels of other colors (S35).

Figure 15:
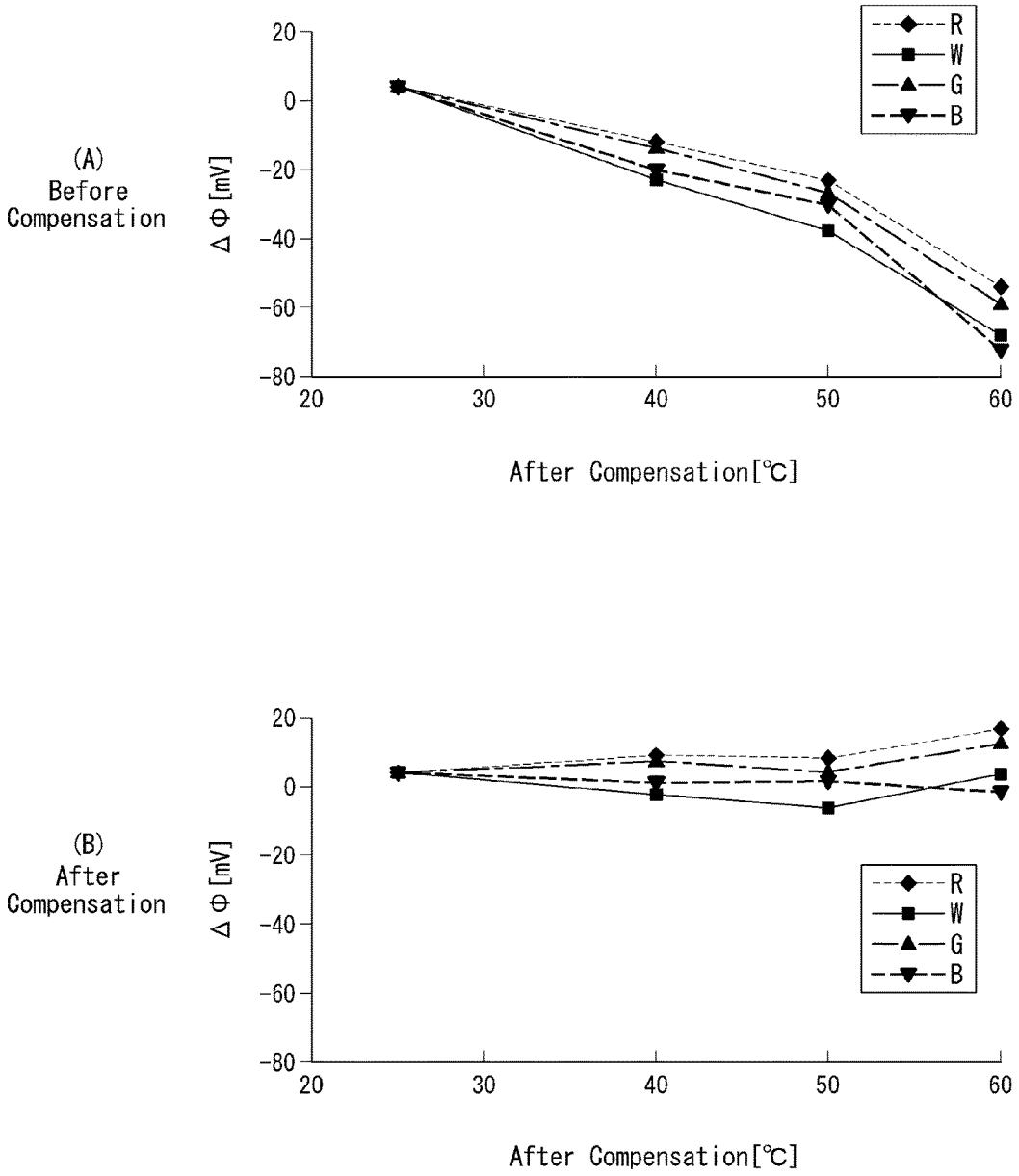
FIG. 15 shows a simulation result showing effects of compensation of threshold voltages of all pixels according to the two-point current sensing scheme.
Figure 16:
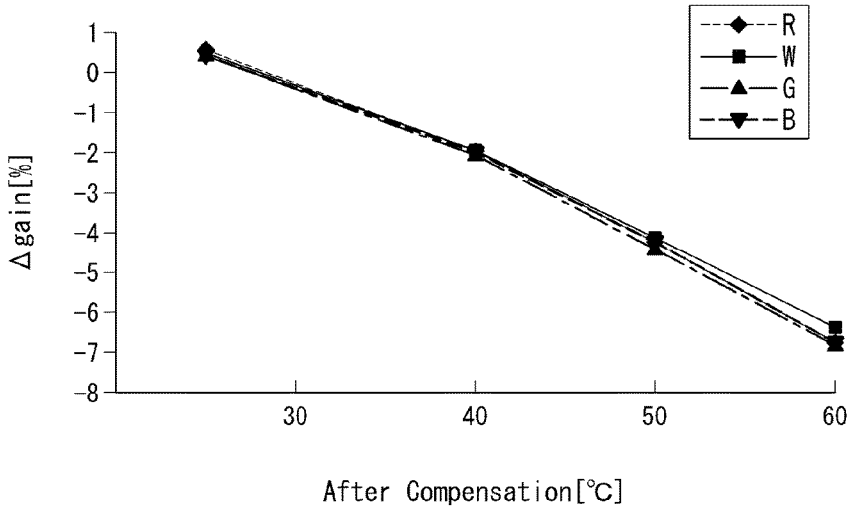
FIG. 16 shows a simulation result showing effects of compensation of electron mobility of all pixels according to a two-point current sensing scheme.
Figure 16:
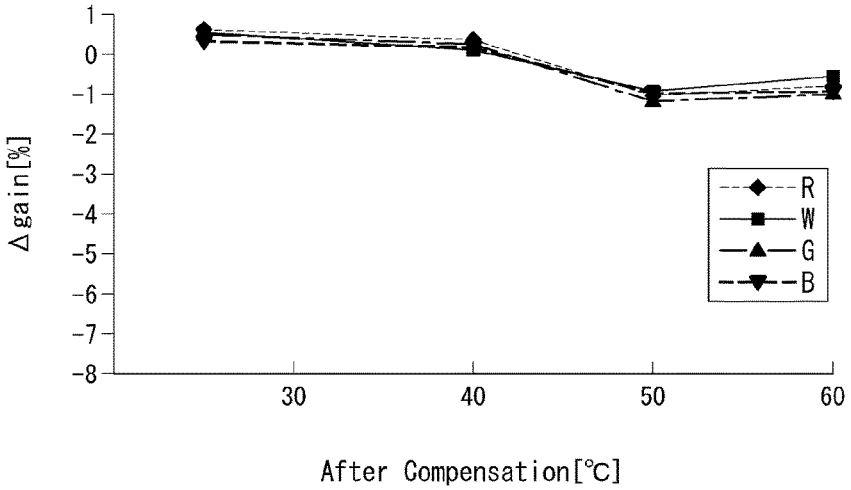

FIG. 15 shows a simulation result showing effects of compensation of threshold voltages of all pixels according to a two-point current sensing scheme. FIG. 16 shows a simulation result showing effects of compensation of electron mobility of all pixels according to a two-point current sensing scheme.

The simulation results shown in FIGS. 15 and 16 show that even though pixels of other colors are compensated using a one-color sensing result dependent upon the two-point current sensing according to the present disclosure, there is no difference in compensation performance. Pixels in the same unit pixel are disposed neighboring each other, and thus, they show the same degree of degradation caused by an external environment. Therefore, even when pixels of other colors are compensated based on sensing data acquired with respect to pixels of one specific color, it does not result in degradation of compensation performance.

As shown in FIG. 15, there is a great deviation in a threshold voltage variation ΔΦ of four color pixels depending on panel temperature before compensation, but such deviation caused by the panel temperature is reduced dramatically after compensation.

Similarly, as shown in FIG. 16, there is a great deviation in an electron mobility variation Δgain of four-color pixels before compensation, but such deviation caused by the panel temperature is reduced dramatically after compensation.

Although the two-point current sensing scheme for continuously sensing a threshold voltage and electron mobility of a driving element are described in an example of one-color sending method in the above aspect, the two-point current sensing scheme may also be applied to the above mulit-color sensing method. In the above mulit-color sensing method, the sensing time may also be further reduced by continuously sensing a driving element included in each pixel of one specific color within one line sensing ON time by employing a two-point current sensing scheme.

As described above, a sensing unit of the present disclosure is implemented as a current-voltage converter to directly sense a pixel current flowing in each pixel, and therefore, it is possible to sense a micro-current at a low gray level and perform sensing more quickly. As a result, it is possible to increase sensitivity while reducing a sensing time.

In particular, the present disclosure employs a one-color sensing method to sense electrical characteristics of each driving elements in pixels of one specific color from among multiple colors, without sensing pixels of other colors, and therefore, it is possible to reduce a sensing time to 1/K (K is the number of colors), compared to a multiple-color sequential sensing method.

Furthermore, the present disclosure employs a one-color sensing method to sense only pixels of one specific color, while utilizing a two-point current sensing scheme to continuously sense a threshold voltage and electron mobility of each driving element in pixels of the one specific color within one line sensing ON time, thereby possibly further reducing a sensing time.

While the present disclosure has been described in detail with regards to several aspects, it should be appreciated that various modifications and variations may be made in the present disclosure without departing from the scope or spirit of the disclosure. In this regard it is important to note that practicing the disclosure is not limited to the applications described hereinabove.

What is claimed is:

1. An electroluminescent display device, comprising:

a display panel, including a plurality of data lines, a plurality of sensing lines, a plurality of gate lines, and pixels of multiple colors which are arranged in matrix at each intersection between those lines to form a plurality of display lines, a sensing circuit, for sensing a pixel current in the pixels, integrating the pixel current to obtain a sensing voltage, and generating a sensing data based on the sensing voltage during a sensing operation period, wherein the sensing circuit senses pixels of one specific color among the pixels of multiple colors to obtain electrical characteristics of the pixels of the multiple colors, and continuously senses a threshold voltage and an electron mobility of a driving TFT in the pixels of the one specific color as the sensing data; and a compensation unit for calculating a compensation value for electrical characteristics of a threshold voltage and an electron mobility of a driving TFT of the pixels of the multiple colors based on the sensing data of the threshold voltage and the electron mobility of the driving TFT in the pixels of the one specific color, wherein the sensing circuit continuously senses the threshold voltage and the electron mobility of the driving TFT in the pixels of the one specific color within one line sensing ON time that is allocated to sense the pixels of the one specific color arranged in one display line among the plurality of display lines, and wherein the one display line includes a group of pixels arranged to be adjacent to each other along a horizontal direction where the plurality of gate lines extends.

2. The electroluminescent display device according to claim 1, wherein the sensing circuit includes a sensing unit, which includes:

an amplifier, including an inverting input terminal which is connected to the sensing line and receives the pixel current from the sensing line, a non-inverting input terminal which receives a reference voltage, and an output terminal that outputs the sensing voltage;

an integrating capacitor connected between the inverting input terminal and the output terminal; and a first switch connected to both ends of the integrating capacitor.

3. The electroluminescent display device according to claim 2, wherein each pixel includes:

an OLED for emitting light according to the pixel current;

a driving TFT for generating the pixel current depending on a gate-source voltage, including a gate electrode connected to a first node, a drain electrode connected to a high-potential driving voltage, and a source electrode connected to a second node;

a first switch TFT including a gate electrode connected to the gate line, a drain electrode connected to the data line, and a source electrode connected to the first node; and a second switch TFT including a gate electrode connected to the gate line, a drain electrode connected to the sensing line, and a source electrode connected to the second node.

4. The electroluminescent display device according to claim 3, wherein the sensing operation period includes an initialization period and a sensing period, and wherein in the initialization period, the first switch, the first switch TFT, and the second switch TFT are turned on so as to initialize the second node to the reference voltage and to apply a sensing data voltage to the first node N1 through the data line, thereby causing the pixel current corresponding to a potential difference between the first node and the second node to flow in the driving TFT, and in the sensing period, the first switch TFT and the second switch TFT remain turned-on and the first switch is turned off, thereby causing the amplifier to integrate the pixel current flowing in the driving TFT and to output the sensing voltage.

5. The electroluminescent display device according to claim 1, wherein the sensing circuit continuously senses the threshold voltage and the electron mobility of the driving TFT in the pixels of the one specific color within one line sensing ON time is performed by employing a two-point current sensing scheme, wherein the two-point current sensing scheme is a sensing method, over a voltage-current curve, using a first point in a low gray level area where a threshold voltage variation has more influence than an electron mobility variation and a second point in a high gray level area where the electron mobility variation has more influence than the threshold voltage variation.

6. The electroluminescent display device according to claim 1, wherein the compensation unit retrieves a threshold voltage-related compensation parameter and an electron mobility-related compensation parameter from a memory, wherein, the sensing circuit performs a two-point sensing on the pixels of the one specific color repeatedly with respect to each of the display lines, to obtain a first sensing data for sensing the threshold voltage and a second sensing data for sensing the electron mobility, and the compensation unit calculates a threshold voltage compensation value for a driving TFT between pixels of the one specific color and pixels of other colors based on the first sensing data which is acquired with respect to the pixels of the one specific color, calculates an electron mobility compensation value for a driving TFT between the pixels of the one specific color and pixels of other colors based on the second sensing data which is acquired with respect to the pixels of the one specific color, updates the threshold voltage-related compensation parameter in the memory with the threshold voltage compensation value, and updates the electron mobility-related compensation parameter in the memory with the electron mobility compensation value.

7. The electroluminescent display device according to claim 6, wherein the sensing circuit is configured to:

use the first point in the low gray level area and the second point in the high gray level area over the voltage-current curve, to generate a first sensing data voltage corresponding to the first point and a second sensing data voltage corresponding to the second point;

sense a first pixel current according to the first sensing data voltage in a first section for sensing the threshold voltage included in the one line sensing ON time, the first section including a first initialization period and a first sensing period, and the first pixel current flowing in pixels of the one specific color in a corresponding display line during the first initialization period;

integrate the first pixel current which flows in the pixels of the one specific color during the first sensing period, so as to output a first sensing voltage and to generate a first sensing data based on the first sensing voltage;

sense a second pixel current according to the second sensing data voltage in a second section for sensing the electron mobility included in the one line sensing ON time, the second section including a second initialization period and a second sensing period, and the second pixel current flowing in pixels of the one specific color in a corresponding display line during the second initialization period; and integrate the second pixel current which flows in the pixels of the one specific color during the second sensing period so as to output a second sensing voltage and to generate a second sensing data based on the second sensing voltage.

8. The electroluminescent display device according to claim 7, wherein the first section takes longer in time than the second section to increase sensing accuracy.

9. The electroluminescent display device according to claim 6, wherein the compensation unit derives a threshold voltage variation dependent upon the first sensing data, and calculates the threshold voltage compensation values for driving TFT in the pixels of each color by adding the threshold voltage variation to an initial threshold voltage compensation value included in the threshold voltage-related compensation parameter and then adding its sum to an offset for each color, and derives an electron mobility variation dependent upon the second sensing data, and calculates the electron mobility compensation values for driving TFT in the pixels of each color by adding the electron mobility variation to an initial electron mobility compensation value included in the electron mobility-related compensation parameter and then multiplying its sum by an weight for each color.

10. A driving method for an electroluminescent display device, the electroluminescent display device comprising a display panel which includes a plurality of data lines, a plurality of sensing lines, a plurality of gate lines, and pixels of multiple colors which are arranged in matrix at each intersection between those lines to form a plurality of display lines, the method comprising:

sensing a pixel current in the pixels during a sensing operation period, wherein the pixels of one specific color among the pixels of multiple colors are sensed to obtain electrical characteristics of the pixels of each color, and a threshold voltage and an electron mobility of a driving TFT in the pixels of the one specific color are continuously sensed;

integrating the pixel current to obtain a sensing voltage, and generating a sensing data based on the sensing voltage; and calculating a compensation value for the threshold voltage and an electron mobility of the driving TFT in the pixels based on the sensing data, wherein the threshold voltage and the electron mobility of the driving TFT in the pixels of the one specific color are continuously sensed within one line sensing ON time that is allocated to sense the pixels of the one specific color arranged in one display line among the plurality of display lines, and wherein the one display line includes a group of pixels arranged to be adjacent to each other along one horizontal direction where the plurality of gate lines extend.

11. The driving method for the electroluminescent display device according to claim 10, wherein a threshold voltage and an electron mobility of a driving TFT included in the pixels of the one specific color are continuously sensed within one line sensing ON time by employing a two-point current sensing scheme, wherein the one line sensing ON time is a time allocated to sense the pixels of the one specific color arranged in one display line among the plurality of display lines, and wherein the two-point current sensing scheme a sensing method, over a voltage-current curve, using a first point in a low gray level area where a threshold voltage variation has more influence than an electron mobility variation and a second point in a high gray level area where the electron mobility variation has more influence than the threshold voltage variation.

12. The driving method for the electroluminescent display device according to claim 11, wherein the step of sensing continuously the threshold voltage and the electron mobility of a driving TFT included in the pixels of the one specific color within the one line sensing ON time by employing the two-point current sensing scheme includes:

retrieve a threshold voltage-related compensation parameter and an electron mobility-related compensation parameter from a memory;

performing a two-point sensing on the pixels of the one specific color repeatedly with respect to each of the display lines, to obtain a first sensing data for sensing the threshold voltage and a second sensing data for sensing the electron mobility;

calculating a threshold voltage compensation value for a driving TFT between pixels of the one specific color and pixels of other colors based on the first sensing data which is acquired with respect to the pixels of the one specific color, and calculating an electron mobility compensation value for a driving TFT between the pixels of the one specific color and pixels of other colors based on the second sensing data which is acquired with respect to the pixels of the one specific color; and updating the threshold voltage-related compensation parameter in the memory with the threshold voltage compensation value, and updating the electron mobility-related compensation parameter in the memory with the electron mobility compensation value.

13. The driving method for the electroluminescent display device according to claim 12, wherein the step of performing the two-point sensing on the pixels of the one specific color includes:

using the first point in the low gray level area and the second point in the high gray level area over the voltage-current curve, to generate a first sensing data voltage corresponding to the first point and a second sensing data voltage corresponding to the second point;

sensing a first pixel current according to the first sensing data voltage in a first section for sensing the threshold voltage included in the one line sensing ON time, the first section including a first initialization period and a first sensing period, the first pixel current flowing in pixels of the one specific color in a corresponding display line during the first initialization period;

integrating the first pixel current which flows in the pixels of the one specific color during the first sensing period, so as to output a first sensing voltage and to generate a first sensing data based on the first sensing voltage; and sensing a second pixel current according to the second sensing data voltage in a second section for sensing the electron mobility included in the one line sensing ON time, the second section including a second initialization period and a second sensing period, the second pixel current flowing in pixels of the one specific color in a corresponding display line during the second initialization period;

integrating the second pixel current which flows in the pixels of the one specific color during the second sensing period, so as to output a second sensing voltage and to generate a second sensing data based on the second sensing voltage.

14. The driving method for the electroluminescent display device according to claim 13, wherein the first section takes longer in time than the second section to increase sensing accuracy.

15. The driving method for the electroluminescent display device according to claim 12, wherein, the step of calculating the threshold voltage compensation value includes:

deriving a threshold voltage variation dependent upon the first sensing data, and calculating the threshold voltage compensation values for driving TFT in the pixels of each color by adding the threshold voltage variation to an initial threshold voltage compensation value included in the threshold voltage-related compensation parameter and then adding its sum to an offset for each color, and wherein, the step of calculating the electron mobility compensation value includes:

deriving an electron mobility variation dependent upon the second sensing data, and calculating the electron mobility compensation values for driving TFT in the pixels of each color by adding the electron mobility variation to an initial electron mobility compensation value included in the electron mobility-related compensation parameter and then multiplying its sum by an weight for each color.

* * * * *